United States Patent [19]

Oeij et al.

[11] Patent Number: 4,750,554

[45] Date of Patent: Jun. 14, 1988

[54] INTERNAL TUBE SHEET SEALING APPARATUS ASSEMBLY FOR TUBULAR HEAT EXCHANGERS

[75] Inventors: Djin K. Oeij, Nootdorp; Willem H. Brouwer, Leiden; Adrianus C. J. Jansen, Zeewinde, all of Netherlands

[73] Assignee: Lummus Crest, Inc., Bloomfield, N.J.

[21] Appl. No.: 853,524

[22] Filed: Apr. 18, 1986

Related U.S. Application Data

[63] Continuation of Ser. No. 684,959, Dec. 12, 1984, abandoned.

[51] Int. Cl.[1] ..... F28F 9/06

[52] U.S. Cl. ..... 165/158; 165/72

[58] Field of Search ..... 165/158, 72, 173, 75

[56] References Cited

U.S. PATENT DOCUMENTS

| | | | |
|---|---|---|---|
| 1,373,041 | 3/1921 | Witte | 165/158 |
| 1,862,310 | 6/1932 | How | 165/158 |
| 2,298,511 | 10/1942 | Rathbun | 165/158 |
| 2,520,755 | 8/1950 | Brown, Jr. | 165/158 |
| 3,114,415 | 12/1963 | Ubntza | 165/158 |
| 3,526,275 | 9/1970 | Vance et al. | 165/158 |
| 4,325,428 | 4/1982 | Schuurman | 165/158 |
| 4,630,673 | 12/1986 | Belleli | 165/158 |

FOREIGN PATENT DOCUMENTS

| | | | |
|---|---|---|---|
| 571203 | 2/1959 | Canada | 165/158 |
| 907899 | 2/1954 | Fed. Rep. of Germany | 165/158 |
| 1149368 | 5/1963 | Fed. Rep. of Germany | 165/158 |
| 663011 | 12/1951 | United Kingdom | 165/158 |

*Primary Examiner*—Ira S. Lazarus
*Assistant Examiner*—Peggy Neils
*Attorney, Agent, or Firm*—Richard H. Berneike

[57] ABSTRACT

Internal tube sheet sealing apparatus assembly for tubular heat exchangers which operate with pressures of, e.g., greater than 1000 psi on both sides of the tube sheet and wherein the tube sheet itself is usually subject to a lower differential pressure, comprising tube sheet loading means including a plurality of shear means assemblies and bolts the can load the tube sheet joint independently of each other, said tube sheet loading means enabling (1) the tightness of the tube sheet joint and tube joints to be inspected during differential pressure hydrotesting of the shell side without the channel cover assembly mounted in place and (2) "in-service" re-loading of the tube sheet joint without removing the channel cover assembly.

7 Claims, 3 Drawing Sheets

INTERNAL TUBE SHEET SEALING APPARATUS ASSEMBLY FOR TUBULAR HEAT EXCHANGERS

This is a continuation of application Ser. No. 684,959, filed on Dec. 12, 1984 now abandoned.

BACKGROUND OF THE INVENTION

1. Field of the Invention

The present invention relates generally to an internal tube sheet sealing apparatus assembly for tubular heat exchangers. More particularly, this invention relates to tubular heat exchangers of the shell-and-tube type having removable bundles such as those with U-tubes and floating heads that are designed to operate under conditions of pressures exceeding, e.g., 1000 psi on both sides of the tube sheet and wherein the tube sheet itself is usually subject to a lower differential pressure; and that have an internal tube sheet sealing apparatus.

2. Description of the Prior Art

Shell-and-tube type heat exchangers constitute the bulk of the unfired heat transfer equipment in chemical plants, petroleum refineries, steam plants, and similar installations. Heat exchangers having removable tube bundles, such as those with U-tubes and a floating head, or having non-removable bundles with fixed tube sheets are among the most popular exchangers of the principal types of shell-and-tube heat exchangers in current usage. In practice, it is desriable to hydrostatically or pneumatically test the shell side of tubular heat exchangers, including those with removable tube bundles, so that visual inspection of the tube joints and tube sheet gaskets can be made and leaks can be readily located and serviced. Generally, leak detection is not a problem. However, when leaks have to be determined without ready access to the tube ends, it may be necessary to re-roll or re-weld all the tube-to-tube sheet joints, thereby incurring substantial risk of possible damage to the satisfactory joints. The problem of leak detection becomes especially acute when the tubular heat exchanger is intended for high pressure operations exceeding 1000 psi especially those under which the pressures exceed 2000 psi on both sides of the tube sheet and the tube sheet itself is subject only to a lower differential pressure. For pressures between 1000 psi and less than 2000 psi, bolts can be used to help constrain the hydrostatic end loads. However, for pressures exceeding 2000 psi, it is advisable to use shear members. Therefore, for high pressure operations it is especially desirable to hydrostatically or pneumatically test, at differential pressure, the shell side of such tubular exchangers upon completion of shop fabrication and/or during maintenance operations to detect leaks at the tube sheet when the high pressure end closure is not (yet) in place. However, all of the above circumstances and operating conditions have led to the adoption of many different technical solutions, many of which have only been partially successful because they have only resolved some problems and introduced others.

For example, U.S. Pat. No. 2,223,320 specifically discloses how to avoid the use of bolts to resist the hydrostatic force acting on the tube sheet by utilizing a telescopic extension, welded to the shell and secured by pins or plugs held in place by solder or other material. However, the solution disclosed by this patent does not enable the tube sheet joint and tube joints to be tested without the channel cover and its loading devices employed in place. With multiple tube side passes, moreover, the use of partition means to separate such passes within the channel, has led to the development of the pass partition box, which must also be kept sealed in order to prevent leaks between passes. In such a system, therefore, the stationary tube sheet is not the only site of leaks, because the pass partition box in such a system poses another type of leakage problem by being an additional site for leaks. U.S. Pat. No. 2,956,704 relates to such a situation. This patent discloses the use of a pipe and flanges as a sealing means to replace the partition box, and permits the tube sheet joint to be tested hydrostatically in the absence of the channel cover. However, the tube sheet joint of this patent can not be re-loaded while in service.

Therefore, there has existed for a long time an unsatisfied need in the art for an internal tube sheet sealing means, especially one that can perform the dual functions of (a) sealing a stationary tube sheet in a tubular heat exchanger having a removable tube bundle and of (b) sealing a pass partition box, both functions being carried out under pressures exceeding at least 1000 psi, or 2000 psi, on both sides of the tube sheet and with the tube sheet itself being subject to a usually lower differential pressure. There has especially been an unsatisfied need for a system of tube sheet sealing means capable of effecting such functions under such pressures through the use of a special means for loading the tube sheet which not only enables the tube sheet joint and tube joints to be tested by differential pressure hydrostatic testing without the channel cover and end closure components mounted in place, but also to enable the tube sheet joint to be retightened, as needed, through the use of means mounted externally to the exchanger.

SUMMARY OF THE INVENTION

The present invention is believed to fill these hitherto unsatisfied needs by providing (a) a tube sheet loading means for a tubular heat exchanger of a shell-and-tube type having a removable tube bundle such as one with U-tubes or a floating head, and (b) including two independent means for sealing the tube sheet joint, thereby enabling differential pressure hydrostatic testing of the shell side without channel cover assembly in place and also reloading of the tube sheet joint while it is in service.

BRIEF DESCRIPTION OF THE DRAWINGS

The above and other features and advantages of the present invention will become more readily apparent from the following description of the invention with reference to FIGS. 1–3 of the accompanying drawings.

DESCRIPTION OF THE PREFERRED EMBODIMENTS OF THE INVENTION

Figure 1:
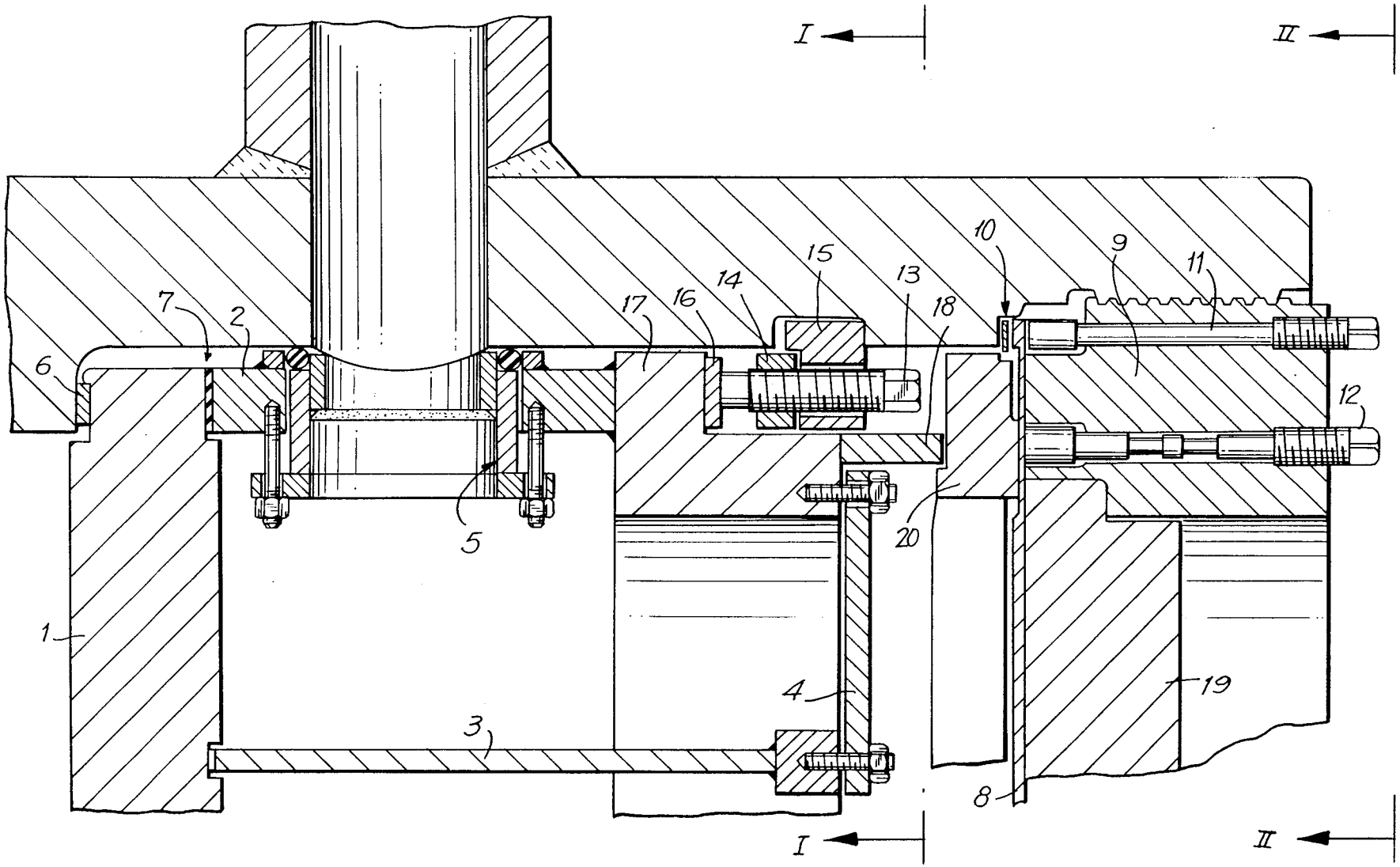
FIG. 1 depicts a semi-longitudinal section of a tubular heat exchanger (e.g., one having a removable tube bundle such as one with U-tubes and floating head showing the area between the tube sheet and the channel cover), and it provides a side elevational view of the internal tube sheet sealing apparatus assembly of the present invention.

Referring now to FIG. 1 of the drawings, there is shown a semi-longitudinal section of a shell-and-tube heat exchanger that is useful for the purposes of this invention, as indicated above. Thus, such exchanger has a number of conventional components that in and of themselves are not part of the inventive essence of this invention; therefore they are not shown in the drawings. For example, the exchanger has a shell with a head at one end, contains a tubular bundle, and has a channel with nozzles providing access for fluid to enter the tubes of the bundle. The channel is closed at its end by a known type of cover and end closure, which provides also the means to tighten the tube sheet joint from the outside.

The shell is separated from the channel by a tube sheet 1 having a plurality of holes arranged in a suitable pattern to accommodate the tubes of the bundle. Some of these tube holes serve as an entrance into the bundle for the fluid passing through the channel inlet and the remainder of the holes serve as an outlet from the bundle. Since it is preferable to have multiple tube passes, the present exchanger preferably has a partition assembly to accommodate this. The partition assembly comprises a partition ring 2, a plurality of partition plates 3, and a partition cover 4 to control the fluid flow from the channel inlet nozzle through two or more tube passes to the channel outlet nozzle, each inlet pass proceeding with the flow of fluid from the channel inlet nozzle and each outlet pass proceeding, in like manner, with the flow of fluid to the channel outlet nozzle. The partition plates 3 in particular direct these respective flows. The partition plates 3 are welded to the partition ring 2 and together they form the partition box, which is closed by the partition cover 4, which, in turn, is secured to the partition box, preferably by bolts.

In order to prevent fluid flow from the channel inlet nozzle to spaces or areas other than the inlet compartment of the partition box, this compartment is provided with a gland or stuffing box 5 by means of which gasket material is compressed within the confines of the channel wall, partition ring 2, and gland 5 to provide a seal between the inlet nozzle and the inlet compartment of the partition box. The gland and the gasket conform with the interior configuration or contour of the channel wall. The function of the partition ring 2 is not only to serve as a part of the partition box but also to transmit the axial load required to seal the tube sheet 1 to the shell at a joint 6 via a partition box gasket 7 and a shoulder on the upper end of the tube sheet.

In a construction in which a preferred embodiment of this invention is used, the end closure is one readily permitting insertion and withdrawal of internal equipment such as the removable tubular bundle while also being capable, during operation, of maintaining a tight seal under high pressure. A typical embodiment of such an end closure is the so-called breech block (or split key ring) design wherein an interrupted ring, i.e., one divided into sections (usually three or more) called shear blocks, are integral with the head or plug of an end closure which is adapted to fit inside the counterbore in the cylindrical end of the heat exchanger. The spaces between blocks permit the end closure to be inserted. The closure is then rotated, thereby aligning and locking the blocks.

In another embodiment of the breech block design, a multiplicity of levels can be produced by using a continuous or interrupted helical groove such as some form of a buttress thread, which is perhaps the simplest and most efficient type of closure, especially for medium size commercial vessels.

For purposes of this invention, however, other known end closure designs, apart from that of the breech block design, may be used, since they as well per se do not comprise a novel element of this invention. Non-limiting examples of such alternative designs include the use of external shear studs, bands, or pins, including the multi-level varieties thereof.

The preferred type of breech block design end closure used in combination with the novel or second shear means assembly of the present invention is that known in the art as the "Breech Lock design," which will be discussed below with reference to the drawings.

In this construction, as noted, use is made of two specific independent shear means assemblies to load or seal the tube sheet joint. The known "Breech Lock" end closure, as contemplated for use with the present invention, comprises one of these assemblies: a first shear means assembly having a lock ring 9 which acts as the first shear means in this assembly. Lock ring 9 is threaded into the shell of the heat exchanger, the shell itself being provided with an internal thread. A diaphragm 8 is adapted for engagement with a channel cover 19 so that the hydrostatic end load from the channel interior can be transmitted, via diaphragm 8, to the channel cover 19. The tendency of the channel cover to move outwards is, however, prevented by the first shear means or lock ring 9. The channel is sealed by a diaphragm gasket 10, which is compressed by an outer row of peripherally arranged axial compression bolts (and push rods) 11 which pass through threaded holes in the lock ring 9 of the first shear means assembly—and transmit their force via a loose (outer) compression ring to the rim of the diaphragm 8 and its gasket 10.

A second or inner row of peripherally arranged axial compression bolts (and push rods) 12 having a corresponding loose (inner) compression ring provides another independent means for exerting an axial load, via the channel internals, comprising the second shear means assembly of this invention (to be described later), onto the tube sheet 1 to the joint 6.

During the operation of the exchanger, the tube sheet joint can be resealed, simply by retightening bolts 12. This is an important feature in that, if the tube sheet joint were to leak slightly during operation, owing to the effects of differences in thermal expansion, it would not be necessary to remove channel cover 19; all that would have to be done would be to retighten bolts 12.

While the "Breech Lock" end closure, together with the compression bolts, push rods and diaphragm, constitutes a known means for loading or sealing the tube sheet joint, the present invention comprises a novel internal apparatus assembly as another separate means for independently sealing the tube sheet joint. Such assembly comprises the second shear means assembly previously referred to above. For example, the initial sealing load on the gasket at the tube sheet-to-shell joint 6 can be effected by this second shear means assembly—a preferred embodiment of which is depicted in the drawings, where a partition box is used—through the interaction of an axial force - transmitting means, preferably one or more ring means such as, e.g., ring 17, a bolt seating ring 16, and a tapped hole ring 14; a second shear means 15 comprising a segmented shear member (such as a split key ring); an axial force generating means such as, e.g., bolts 13; and the partition ring 2. The second shear means assembly has the advantage that the internal bolts 13 can be tightened when the channel cover 19, lock ring 9, bolts 12, diaphragm 8, a diaphragm vacuum protection device 20, and the partition cover 4 have not yet been mounted, thereby enabling the tightness of the tube sheet-to-shell joint and the tube joints to be inspected during hydrotesting from the shell side. Any leakage can be observed directly and corrected without having to dismantle any channel end closure components.

Without the components 17, 16, 14, 15, and 13, hydrotesting of the internal joints would be awkward. For example, in such a case, joint 6 would have to be loaded by the inner row of bolts (and push rods) 12, through bolts (and push rods) 12 normally exerting pressure on partition ring 2 through diaphragm 8 and diaphragm vacuum protection device 20. The lock ring 9 of the first shear means assembly would have to be installed in order to carry bolts (and push rods) 12 and the compression ring. Without the diaphragm 8 and the channel cover 19 in place, any internal leakage during hydrotesting can be directly observed. However, the lock ring 9, bolts (and push rods) 12, and the compression ring must then be dismantled to effect complete assembly, thereby unloading joint 6. If a completely assembled unit were to be hydrotested, the end closure would have to be dismantled in order for any internal leakage to be located.

Figure 2:
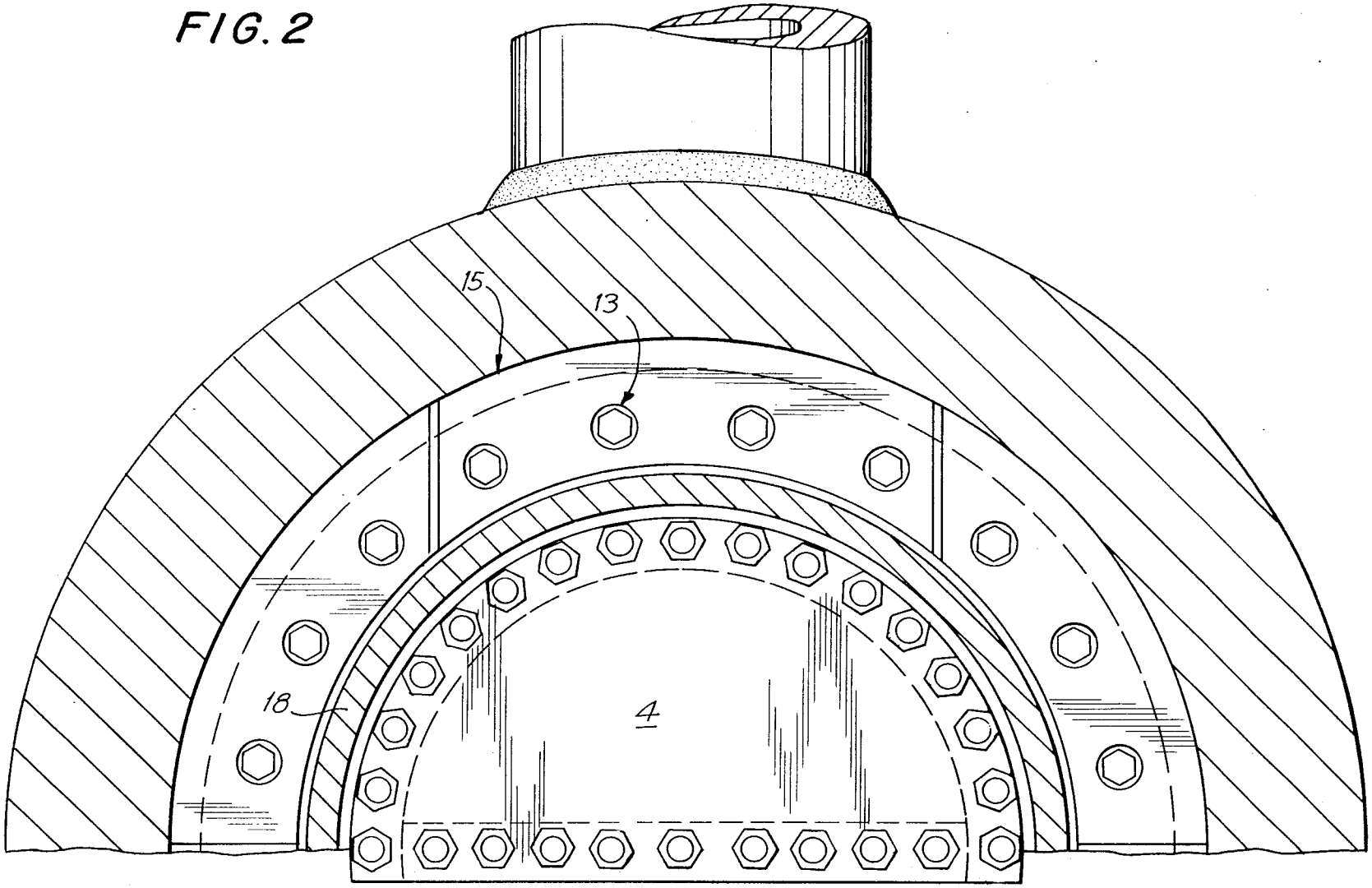
FIG. 2 is a side elevational view of a cross section taken along I—I of FIG. I.
Figure 3:
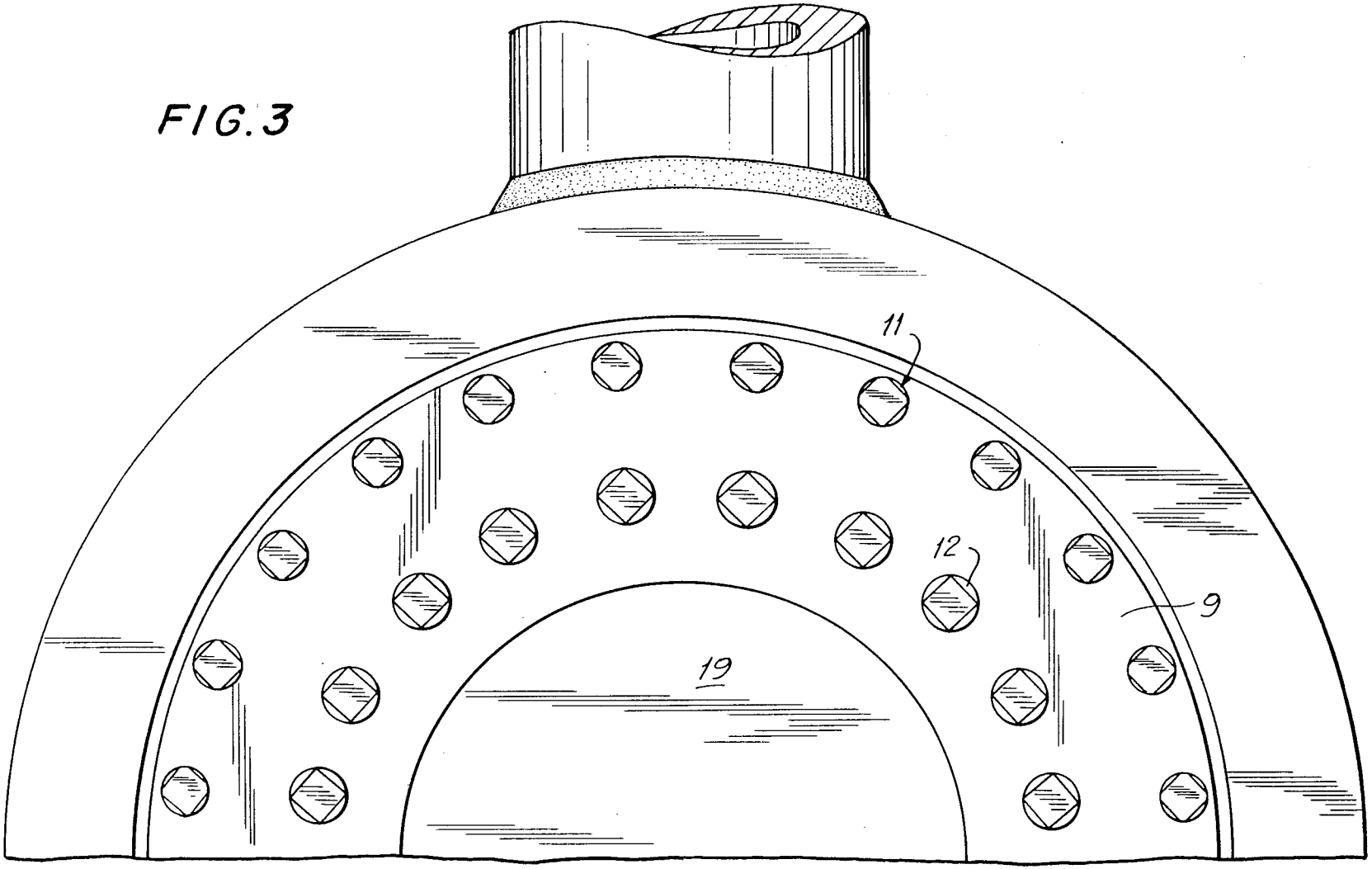
FIG. 3 is an end view taken along II—II of FIG. 2.

The preferred embodiment of the internal apparatus assembly comprising the second shear means assembly of this invention, as depicted in FIGS. 1–3, will now be taken up in greater detail. This preferred embodiment comprises bolts 13, threaded into tapped holes of an internal flange 14, which is capable of axial movement in the channel. Such movement of the internal flange 14, in combination with the force derivable from the tightening of the bolts 13, is used to help effect sealing of the tube sheet joint 6. A secondary effect is to help effect sealing of the gasketed joint between the tube sheet 1 and the partition ring 2. The movement in the radial outward direction of the internal flange 14 is terminable by the segmented shear member (e.g., ring) of second shear means 15 which is recessed to accept the internal flange 14 and has outwardly extending projections that are adapted to be held or engaged by the internal flange 14, thereby terminating the outward axial movement of said internal flange 14. Access for positioning these projections in the groove in the channel wall is created by temporarily displacing the internal flange 14 toward the tube sheet 1. Once this has been done, second shear means 15 can be properly situated and held in place by bolts 13 through corresponding holes in said second shear means 15 into the tapped holes of internal flange 14. The internal apparatus assembly preferably further comprises a bolt seating ring 16 and a ring 17. Bolts 13 are adapted, upon being turned, to engage the bolt seating ring 16 after which torque can be applied so that the bolts 13 exert sufficient force in a longitudinal direction against ring 17 so as to load partition ring 2, which, in turn, transmits that force to the tube sheet joint. It is important to note that, through ring 17, partition ring 2 permits loading of the tube sheet joint to be effected from force transmitted from internal bolts 13 or external bolts 12.

For commercial reasons largely centered on cost, the shell wall and the metals that comprise the internal apparatus assembly comprising the second shear means assembly of this invention may be made of different materials having different coefficients of thermal expansion. Therefore, when the shell wall and the internal apparatus assembly are made of different materials, forces are generated, under operating conditions, owing to the differences in thermal expansion. Under such circumstances, it is preferable to have one means more apt to deform, at a controlled rate, in the face of such forces than any other means, as a source of pressure relief, much like a weak link in a chain.

Accordingly, the function of bolt seating ring 16 is to preferentially deform, at a controlled rate, from the forces developed by differential thermal expansion, thereby protecting other members in the internal apparatus assembly comprising the second shear means of this invention.

The operations of this internal apparatus assembly, as thus described, can all be performed without any of the obstructing channel parts (e.g., the channel cover 19 and other end closure components) present, thereby enabling direct inspection of the tightness of the tube sheet joint and the tube-to-tube sheet connections to be made during application of shell side hydrostatic pressure.

After the tube sheet joint 6 and the tube joints have been tested, the partition cover 4 is bolted on. A load transmission ring 18, and the diaphragm vacuum protection means 20 are then mounted between diaphragm 8 and ring 17 so as to enable the force from the bolts 12 to be transmitted via the diaphragm 8 and the ring 17 to partition ring 2 and the tube sheet joint 6. This makes it possible to tighten the tube sheet joint during operation of the heat exchanger, if the need arises.

The present invention further includes an inventive modification of the push rods 12 which, as normally used in the art, have a cylindrical shape. This modification consists of the use of push rods 12 having locally reduced surface areas so calculated as to be the weakest link in the event that the compression bolts 12 are used to tighten the tube sheet joint 6. It is to be noted that tightening of the compression bolts 12 causes a tendency to release the inner bolts 13, thereby making the weakest link at the bolt seating ring 16 ineffective. Thus, modification of push rods 12 to have locally reduced surface areas thereby provides a new "weakest link" to supersede the function of bolt seating ring 16, which function, as previously noted, took place via preferential deformation from the forces developed by differential thermal expansion.

Thus, as has been seen, the present invention discloses two independent means for sealing a tube sheet joint and pass partition joints in a shell-and-tube type heat exchanger, including a novel internal means. Such invention also discloses how the tube sheet can not only be tested hydrostatically without the channel cover and end closure components mounted in place but also how the internal parts permit retightening, as needed, through the use of bolts external to the exchanger. Further disclosed is the use of two different shear means, externally and internally located each of which can be used independently of the other to load the tube sheet seal and the partition box seal as well, while the invention includes a "weakest link" for each of these different embodiments.

While the invention has been described in terms of exemplary embodiments thereof, it is to be understood that many modifications will be apparent to those of ordinary skill in the art and that this application is intended to cover any such adaptations or variations thereof. Therefore, it is intended that this invention be only limited by the claims and the equivalents thereof.

What is claimed is:

1. In a shell and tube heat exchanger comprising an outer shell assembly having at least one inlet and one outlet and including a joint to receive a tube sheet, a tube sheet in sealing engagement with the joint, the shell assembly defining a channel on one side of the tube sheet, the channel being associated with at least one conduit leading to the interior of the shell assembly for accommodating a flow of fluid passing through the channel, channel closure means for closing said channel, and means engaging said shell and said channel closure means for sealing said channel closure means to said shell, wherein the improvement comprises first adjustable means located inside said shell for applying an axial force to said tube sheet for sealing said tube sheet to said shell, said first adjustable means engaging said shell and located between said tube sheet and said channel closure means and adapted to adjustably seal said tube sheet to said shell prior to installation of said channel closure means whereby said seal may be tested prior to installation of said channel closure means, and second adjustable means separate from said means for sealing said channel closure means and separate from said first adjustable means for applying an axial force from a position outside of said channel closure means to said tube sheet for adjusting the sealing of said tube sheet to said shell after installation of said channel closure means.

2. In a shell and tube heat exchanger according to claim 1, wherein the means for sealing said channel closure means comprises an annular locking assembly threadably mounted in the interior of said shell assembly and a plurality of first bolts mounted in threaded bores therein being operable to apply an axial force for sealing said channel closure means to said shell and wherein said second adjustable means comprises a plurality of second bolts mounted in threaded bores in said annular locking assembly being operable to apply an axial force for sealing said tube sheet.

3. In a shell and a tube heat exchanger according to claim 2 and further including a partition assembly and wherein said second bolts apply said axial force to said partition assembly which transmits said force to the tube sheet.

4. In a shell and tube heat exchanger according to claim 3 wherein the partition assembly comprises a partition ring, a partition cover, and a plurality of partition plates, said partition ring also being responsive to the axial force produced by the first and second adjustable means for transmission of said force to the tube sheet thereby helping to seal said tube sheet to the joint.

5. In a shell and tube heat exchanger according to claim 1 wherein said first adjustable means comprises a ring divided into a plurality of block sections dimensioned to fit inside and engage an annular recess formed in part of the shell assembly which defines said channel and a plurality of third bolts mounted in bores in said ring and being operable to apply an axial force for sealing said tube sheet prior to installation of said channel closure means.

6. In a shell and tube heat exchanger according to claim 5 and further including a deformable ring means between said third bolts and said tube sheet for transmitting said axial force and adapted to preferentially deform at a controlled rate from excess force developed by differential thermal expansion.

7. In a shell and tube heat exchanger according to claim 2 wherein at least some of said second bolts mounted in the annular locking assembly have locally reduced surfaces so as to be responsive to excessive forces developed in said heat exchanger.

* * * * *